US007794550B2

(12) United States Patent
Roth

(10) Patent No.: US 7,794,550 B2
(45) Date of Patent: Sep. 14, 2010

(54) DISHWASHER WITH INDUCTION HEAT UTENSIL DRYING

(75) Inventor: Ryan Kevin Roth, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 437 days.

(21) Appl. No.: 11/856,090

(22) Filed: Sep. 17, 2007

(65) Prior Publication Data

US 2009/0071514 A1 Mar. 19, 2009

(51) Int. Cl.
*B08B 3/00* (2006.01)

(52) U.S. Cl. ..... 134/58 D; 134/56 D; 134/57 D

(58) Field of Classification Search ..... 134/56 D
See application file for complete search history.

(56) References Cited

U.S. PATENT DOCUMENTS 5,882,739 A * 3/1999 Kobos et al. ..... 427/536
2004/0200508 A1* 10/2004 Jung et al. ..... 134/25.2
2005/0126601 A1* 6/2005 Jung et al. ..... 134/25.2
2006/0076037 A1* 4/2006 Kim et al. ..... 134/10

FOREIGN PATENT DOCUMENTS

FR 2821735 A1 * 9/2002
JP 06133915 A * 5/1994
JP 07178034 A * 7/1995
JP 10192217 A * 7/1998

OTHER PUBLICATIONS

English translation of JP-06133915-A.*
Machine translation of JP-10192217-A.*

* cited by examiner

*Primary Examiner*—Michael Barr
*Assistant Examiner*—Charles W Kling
(74) *Attorney, Agent, or Firm*—John W. Morrison; Robert A. Bacon; McGarry Bair P.C.

(57) ABSTRACT

An automatic dishwasher comprises a wash tub having an access opening to define an open-faced wash chamber for holding utensils to be washed, a door movable relative to the wash tub for selectively closing the open-faced wash chamber, a utensil holder located within the wash chamber, and an induction heater for drying utensils within the wash chamber. The induction heater generates a useful magnetic field that projects into the utensil holder.

8 Claims, 5 Drawing Sheets

DISHWASHER WITH INDUCTION HEAT UTENSIL DRYING

BACKGROUND OF THE INVENTION

1. Field of the Invention

The invention relates generally to a dishwasher having a utensil dryer.

2. Description of the Related Art

Automatic dishwashers are commonly found in household environments. A typical automatic dishwasher comprises a cabinet that defines a washing chamber, which is accessible through a moveable door. Typically, an upper and a lower rack for holding utensils to be cleaned are provided within the washing chamber. A silverware basket is also usually provided and normally mounts to the door or lower rack. When the silverware basket is mounted on the door and the door is closed the silverware basket is in the wash chamber allowing it to be sprayed on by the spraying apparatus, which is commonly a rotating spraying arm having multiple nozzles that direct a focused stream of wash liquid known as a jet at the utensils to clean and rinse them.

Dishwashers typically have a drying cycle during which a sump heater, used to heat the water, is selectively activated to heat the washing chamber to dry the utensils by directly evaporating the water and by heating the utensils, which aids in evaporating the residual water. However, for a variety of reasons, rarely are all of the utensils completely dry. Most problematic are those utensils that are in contact with each other or with structures or surfaces in which water can collect or pool in sufficient amount that it will not evaporate during the drying cycle. The silverware basket is one location where the collecting and pooling of water is most common because of the contact between the utensils in the basket and the complex shapes and surfaces of the utensils.

If the utensils are not completely dry at the end of the drying step of the wash cycle, the consumer typically hand dries the utensils that are still wet, much to their annoyance. Therefore, it is desirable to find a way to ensure that all of the utensils are completely dry.

SUMMARY OF THE INVENTION

The invention relates to an automatic dishwasher comprising a housing defining a wash chamber for holding utensils to be washed, and a liquid spraying system, and a drying system. More specifically the automatic dishwasher has a wash tub with an access opening to define an open-faced wash chamber for receiving utensils for washing. The automatic dishwasher also has a door movable relative to the wash tub for selectively closing the open-faced wash chamber. The invention comprises an induction heater, which generates a magnetic field that projects into at least a portion of the wash chamber. The invention is operable in a first mode to dry utensils by induction heating from a source outside of the wash chamber, and operable in a second mode to dry utensils by induction heating from a source inside the wash chamber.

DESCRIPTION OF AN EMBODIMENT OF THE INVENTION

Figure 1:
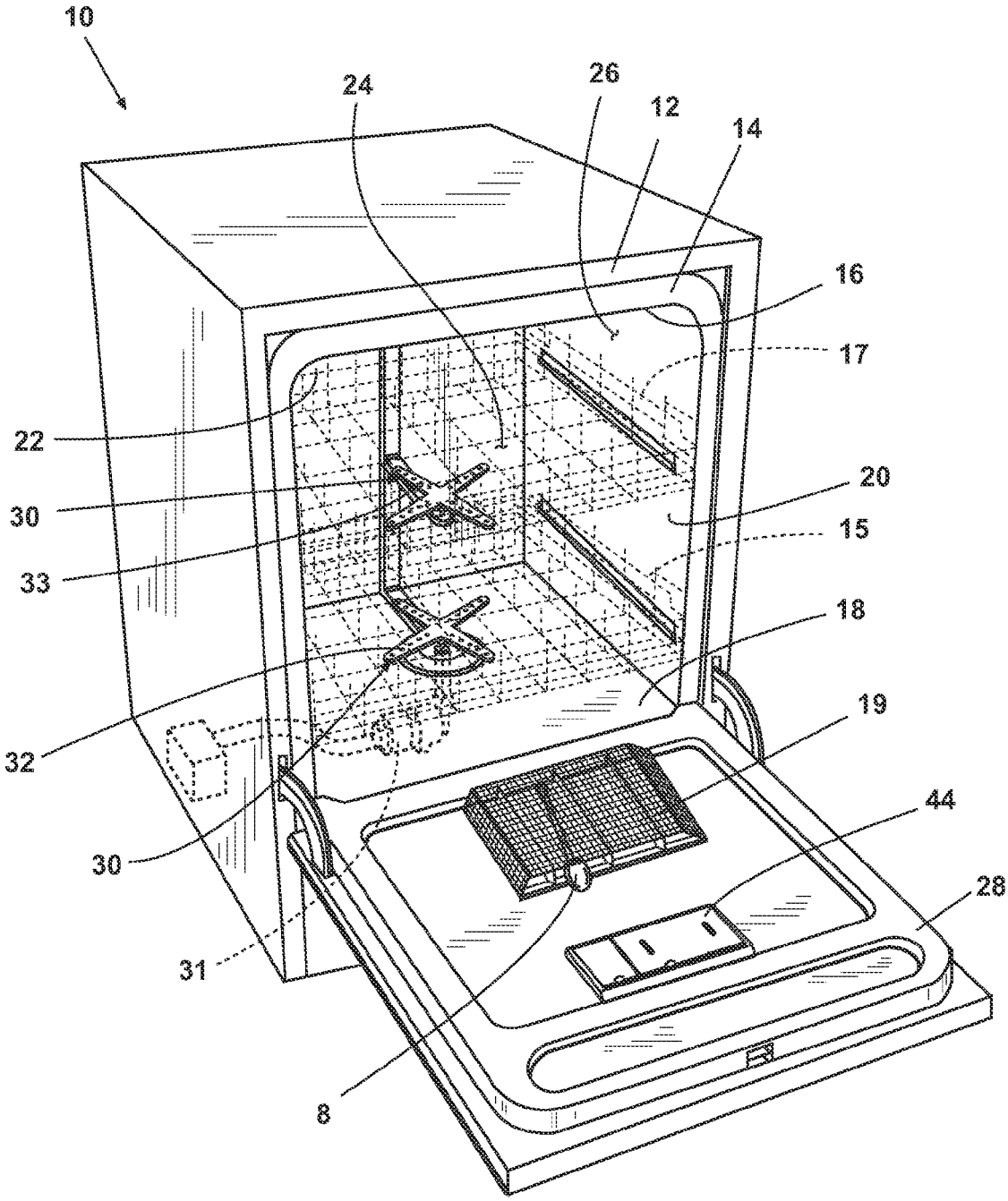
FIG. 1 is a perspective view of a first embodiment of a dishwasher, with the door open.

Referring now to the figures and to FIG. 1 in particular, an embodiment of the invention is illustrated comprising an automated dishwasher 10 having a housing 12 for enclosing a wash tub 14. The dishwasher 10 shares many features of a conventional automated dishwasher, which will not be described in detail herein except as necessary for a complete understanding of the invention. The wash tub 14 has spaced top and bottom walls 16 and 18, spaced side walls 20, and a rear wall 22. The walls 16, 18, 20, and 22 join along their respective edges to define a wash chamber 24 with an access opening in the form of an open face 26. Utensil holders in the form of upper and lower racks 15, 17 are located within the wash chamber 24 and receive utensils for washing. The racks 15, 17 are typically mounted for slidable movement in and out of the wash chamber 24 for ease of loading and unloading. Another utensil holder in the form of a silverware basket 19 is located on the door 28. The silverware basket 19 can be removably mounted to the door.

Utensil holders 15, 17 and 19 all hold various utensils for washing within the wash chamber. As used in this description, the term utensil is generic to dishes and the like that are washed in the dishwasher 10 and expressly includes, dishes, plates, bowls, silverware, glassware, stemware, pots, pans, and the like A utensil, in the form of a spoon 8, is shown located in the silverware basket 19.

A door 28 is hingedly mounted to the dishwasher 10 and can move between an opened position, as illustrated in FIG. 1, to provide access to the wash chamber 24 and a closed position (shown in FIG. 2) to close the wash chamber 24 by covering the open face 26 of the wash chamber 24. Typically, the door 28 is in the opened position when utensils are loaded or unloaded into the dishwasher 10 and in the closed position while the washing cycle is running or while the dishwasher 10 is not in use. A bulk wash aid dispenser 44 is mounted on an inside surface of the door 28 such that the bulk wash aid dispenser 44 is disposed in the wash chamber 24 when the door 28 is in the closed position.

Additionally, the dishwasher 10 comprises a liquid circulation system 30 for introducing and circulating liquid and wash aids, such as detergents, rinse aids, and the like, throughout the wash chamber 24. The liquid circulation system comprises a pump 31 located in a lower portion or sump of the wash tub 14 and which pumps liquid to sprayers 32, 33, and 34. Sprayers 32, 33 are located, respectively, beneath lower rack 15 and upper rack 17 and are illustrated as rotating spray arms. Sprayer 34 is located above the upper rack 17 and is illustrated as a fixed spray nozzle. A sump heater 36 is located in the lower portion of the dishwasher. The sump heater 36 is formed of a resistive heating element which acts to heat the washing fluid. Alternatively, a flow through heater may be used or both could be used in combination.

Figure 2:
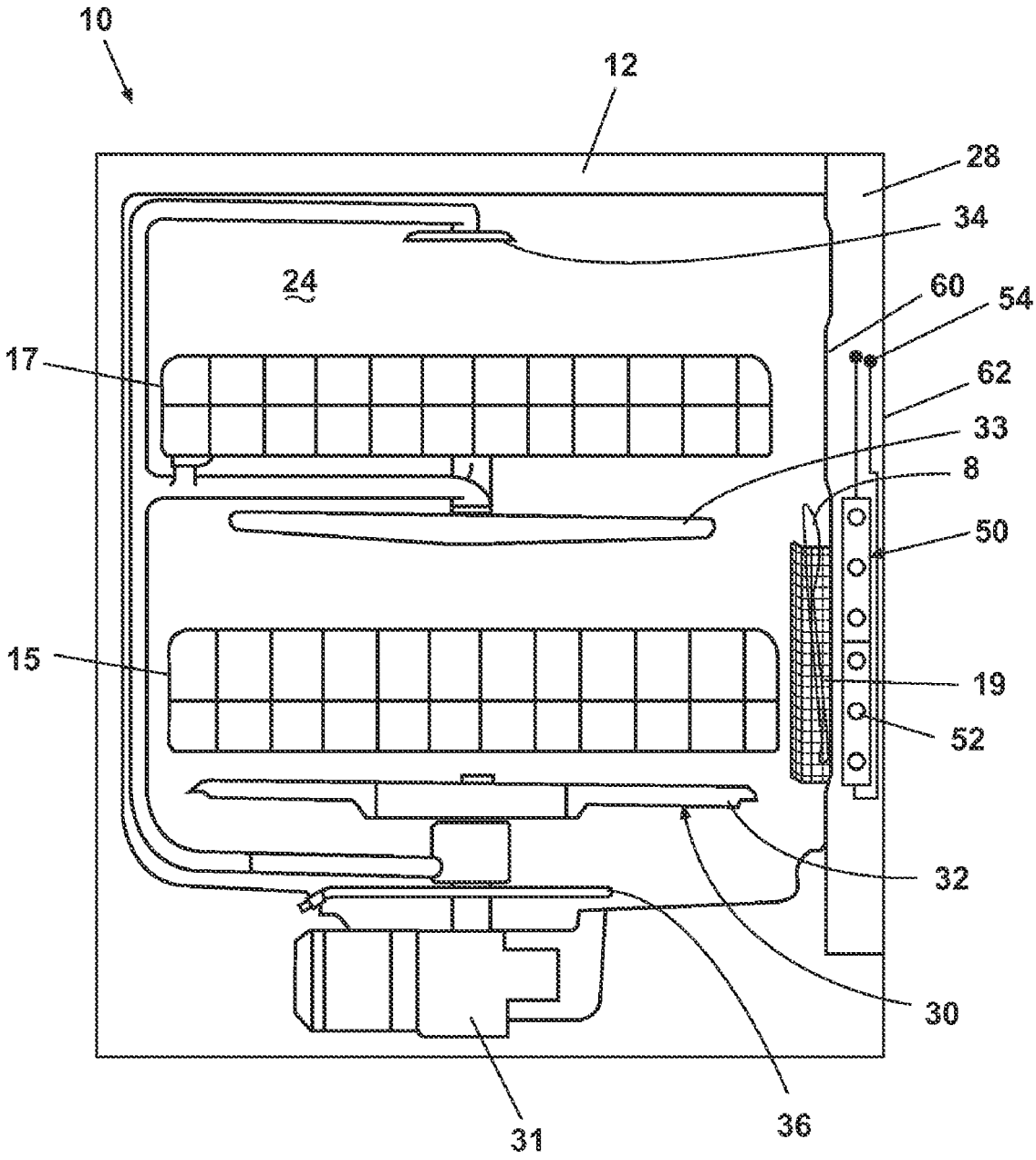
FIG. 2 is a schematic, side-sectional view of the wash chamber, upper and lower racks, and door with silverware basket and induction heater of FIG. 1.

FIG. 2 illustrates a dishwasher 10 in which an induction heater 50 is provided to heat at least some of the utensils in the wash chamber 24. The induction heater 50 is illustrated as being located within the door 28, namely between an inner panel of the door 60 and an outer panel of the door 62. The induction heater assembly 50 comprises an induction coil 52, the ends of which are connected to opposite sides of and excited by a low frequency alternating current source 54. For the induction heater assembly 50 described herein the AC signal applied ranges from 25-50 KHz.

Figure 3:
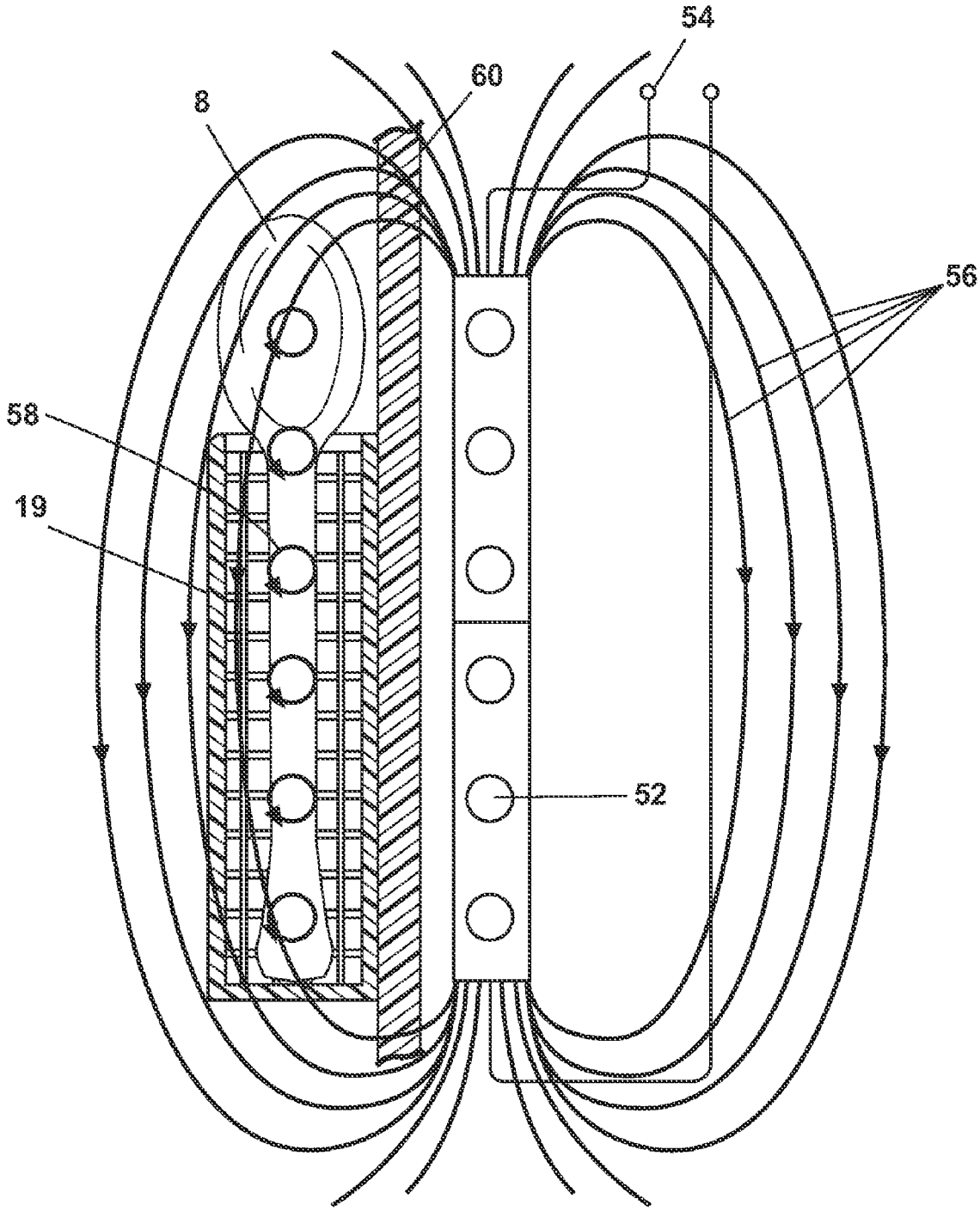
FIG. 3 is a close up, side-section view of the silverware basket and induction heater of FIG. 1.

When the induction coils 52 are excited or energized by the alternating current source 54 an alternating electromagnetic field 56 is produced by the induction coils 52 as illustrated in FIG. 3. The generated electromagnetic field 56 acts on any electrically conductive material within its useful field so that the electrically conductive material is inductively heated. The useful field of the invention is approximately one inch. While any electrically conductive material utensil may be heated in this method so long as it is within the electromagnetic field 56 produced by the induction coils 52 the induction heating will be explained with reference to a utensil in the form of a spoon 8.

The electromagnetic field 56 generates heat directly in the spoon 8 in the form of eddy currents 58. The eddy current is caused by the moving magnetic field 56, which causes a circulating flow of electrons, or current, within the spoon 8. This causes an increase in the temperature of the spoon 8 as a result of its resistance to the electrical current flowing through it. This is commonly referred to as Joule heating. As the spoon 8 is heated water evaporates from the surface of the spoon 8 and drying occurs.

The induction heater 50 can be sized such that it projects a useful field throughout the wash chamber, which could then be used to heat any electrically conductive utensil within the wash chamber. Thus, it is possible that the induction heater 50 could be the only heating element and the sump heater 36 would not be needed. Care must be taken to make sure that heat-sensitive, electrically conductive components of the dishwasher, such as the controller, are not located within the useful field or are shielded from the useful field.

While an induction heater covering the whole of the wash chamber is possible, it is not the preferred approach as the induction heater 50 would not heat non-electrically conductive utensils, such as glassware, which would then be wet upon removal. One possible solution would be to include in the wash chamber 24 electrically conductive heating elements that could directly or indirectly heat the non-electrically conductive utensils. For example, the upper and lower racks could be made of electrically conductive materials and would heat the non-electrically conductive utensils placed in the racks. While these structures are possible, the current implementation of the conductive heater is to heat a portion or an specific area within the wash chamber.

Figure 4:
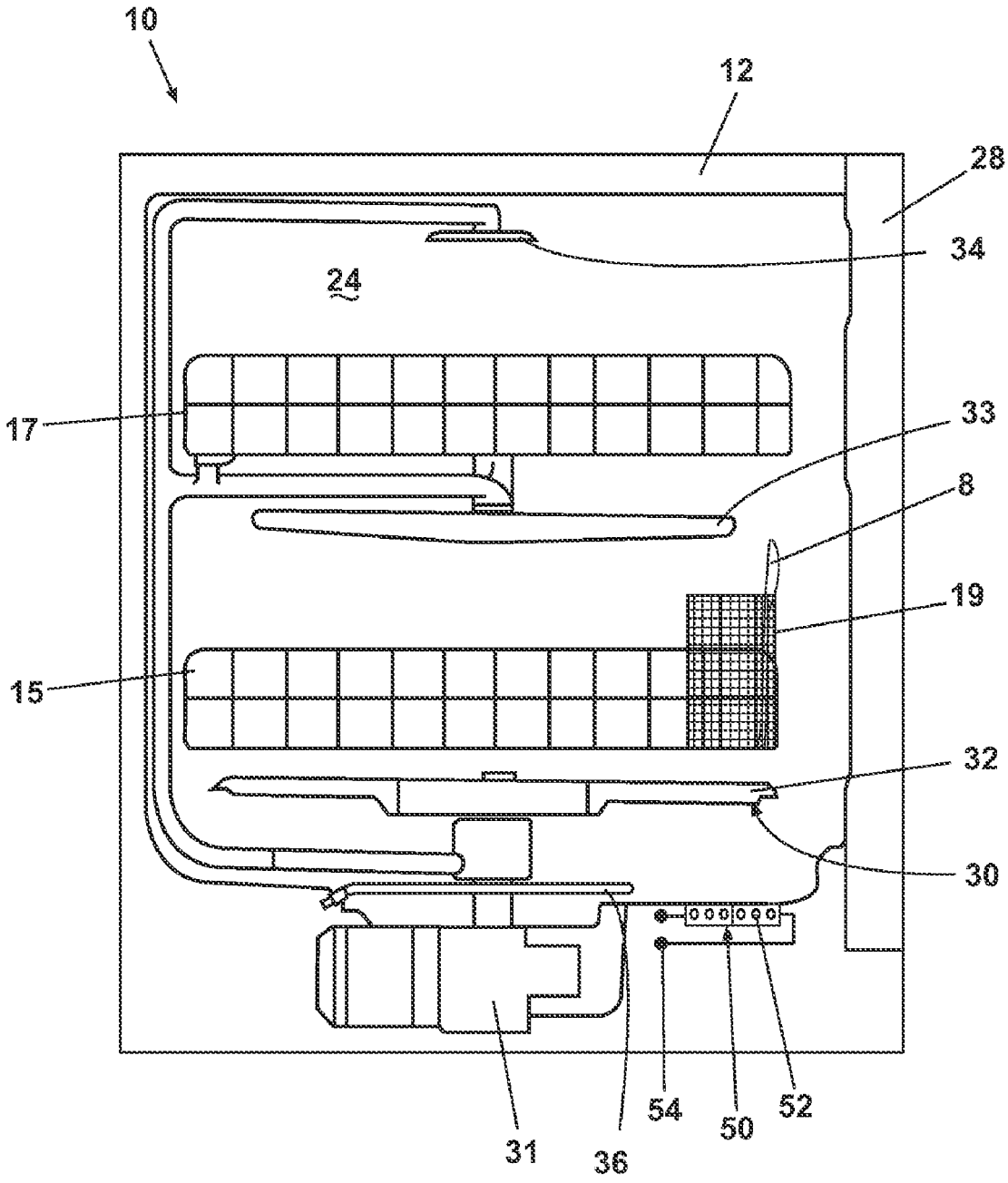
FIG. 4 is a schematic of a second embodiment showing the silverware basket in the lower dish rack with the induction heater exterior of the wash chamber.

FIG. 4 illustrates a second embodiment of the invention wherein the silverware basket 19 is located in the lower rack 15 and the induction heater assembly 50 is located exteriorly of the wash chamber 24. This invention works in the same manner to heat the silverware 8 located in the silverware basket 19 through Joule heating. The silverware 8 and subsequently the silverware basket 19 would have to remain in the useful range of the electromagnetic field 56 produced by the induction coils 52 in order to be effective. The electromagnetic field 56 will affect all electrically conductive material in its projected area. Thus, the inner panel of the door 60 should be comprised of a non-electrically conductive material which will not heat. Its is believed that a low enough alternating current can be used so as to not heat the outer panel of the door 62 should it be made of electrically conductive material. Moreover, there is approximately an inch of insulating material between the induction coils 52 and the outer panel of the door 62 putting it out of range of the electromagnetic field 56. If the automatic washer 10 is designed so that the rotatable sprayer 32 is located within the useful range of the electromagnetic field 56 produced it too should be made of a non-electrically conductive material. Though the silverware basket 19 may be made of a non-electrically conductive material it may also be made of electrically conductive material to aid in drying the silverware 8.

Figure 5:
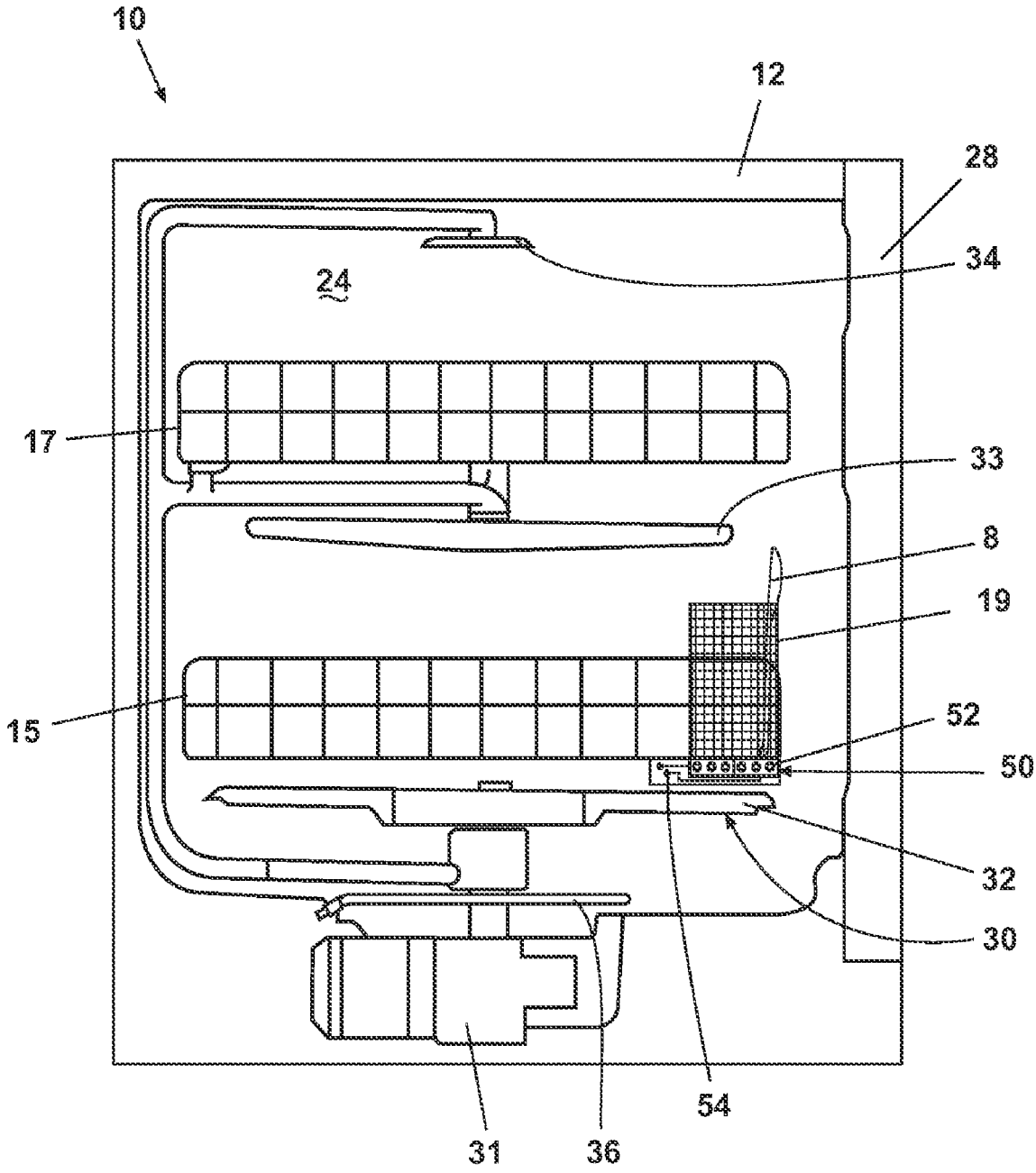
FIG. 5 is a schematic of a third embodiment with the silverware basket in the lower dish rack with the induction heater inside the wash chamber.

FIG. 5 shows a third embodiment of the invention wherein the silverware basket 19 is located in the lower movable rack 15 and the induction heater assembly 50 is mounted on the silverware basket 19 inside the wash chamber 24. The alternating current source 54 would also have to be attached to the induction coil 52 in a manner which would be sufficiently waterproof.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. An automatic dishwasher, comprising:

a wash tub having an access opening to define an open-faced wash chamber for receiving utensils for washing;

a door movable relative to the wash tub for selectively closing the open-faced wash chamber and having an inner surface and an outer surface, which is spaced from the inner surface to define an interior, with a portion of the inner surface being non-metallic;

a utensil holder located within the wash chamber and adjacent to the non-metallic portion of the inner surface; and an induction heater located in the interior of the door and generating a useful magnetic field that passes through the non-metallic portion of the inner surface and projects into the utensil holder.

2. The automatic dishwasher according to claim 1, wherein the dishwasher also comprises a resistive heating element located within a sump portion of the wash tub.

3. The automatic dishwasher according to claim 1, wherein the entire inner surface is non-metallic.

4. The automatic dishwasher according to claim 1, wherein the utensil holder is mounted to the portion of the inner surface.

5. The automatic dishwasher according to claim 4, wherein the utensil holder is a silverware basket.

6. The automatic dishwasher according to claim 1, wherein the utensil holder comprises at least one of a wash rack and a silverware basket.

7. The automatic dishwasher according to claim 6, wherein the utensil holder is a silverware basket.

8. The automatic dishwasher according to claim 7, wherein the silverware basket is mounted to at least one of the wash rack and the door.

* * * * *